United States Patent [19]

Davis

[11] 4,075,415

[45] Feb. 21, 1978

[54] TUBE WITH TERMINAL END CAP

[75] Inventor: Warren C. Davis, Cohasset, Mass.

[73] Assignee: Raytheon Company, Lexington, Mass.

[21] Appl. No.: 757,408

[22] Filed: Jan. 6, 1977

[51] Int. Cl.[2] ..... H01R 13/58

[52] U.S. Cl. ..... 174/50.52; 313/318; 339/103 M

[58] Field of Search ..... 174/50.52, 50.54, 50.59, 174/138 F; 313/318, 477 HC, 477 R; 339/93 R, 93 C, 93 L, 102 R, 102 L, 103 R, 103 M, 104, 144 R, 145 R

[56] References Cited

U.S. PATENT DOCUMENTS

| | | | |
|---|---|---|---|
| 2,477,172 | 7/1949 | Brownlow | 339/104 X |
| 2,619,513 | 11/1952 | Wolfenbarger | 174/59 X |
| 2,990,495 | 6/1961 | Spencer | 313/318 |

*Primary Examiner*—J. V. Truhe
*Assistant Examiner*—D. A. Tone
*Attorney, Agent, or Firm*—John T. Meaney; Joseph D. Pannone; Harold A. Murphy

[57] ABSTRACT

An electron tube including an evacuated envelope having at least one terminal pin extending therefrom and into a dielectric cap comprised of a cylindrical wall encircling the pin and supporting a transversely disposed wall wherein at least one pair of substantially perpendicular openings are disposed, a first wire being attached directly to the pin and routed through one of the openings in the end wall for attachment to a second wire which is routed through the substantially perpendicular opening therein.

10 Claims, 7 Drawing Figures

TUBE WITH TERMINAL END CAP

BACKGROUND OF THE INVENTION

1. Field of the Invention

This invention relates generally to electron tube terminal connectors and is concerned more particularly with a tube terminal end cap having means for supporting wires connected to tube terminal pins.

2. Discussion of the Prior Art

An electron tube generally comprises an evacuated envelope sealed at one end by a vitreous stem having extended hermetically through it an annular array of closely spaced terminal pins. Within the envelope, the pins are electrically connected to associated electrodes of the tube, thereby providing means for making external electrical connections to the electrodes. Accordingly, external portions of the pins may be connected to suitable voltage sources for applying respective electrical potentials to the electrodes during operation of the tube.

External end portions of the terminal pins may be slidably inserted, for example, into aligned resilient contacting sleeves disposed in a dielectric socket member and having respective electrical wires connected thereto. However, during environmental tests, such as mechanical shock, vibration, and thermal shock, for examples, the resiliency of the contacting sleeves may be exceeded, whereby open circuit failures occur. Consequently, for tubes installed in high shock and vibration environments, such as control panels of aircraft, for example, the sleeves socket type of connector may be eliminated and the connecting wires attached directly to the corresponding terminal pins of the tube.

In the latter instance, however, some of the directly connected wires may be heavily insulated due to reliability requirements. Accordingly, in high shock and vibration environments, the heavy insulated wires may act as lavers to cause bending of the attached pins and consequent fracturing of the surrounding vitreous material. Thus, the vacuum-tight seal provided by the vitreous stem may be sufficiently impared to result in voltage breakdown or arc-over occurring within the tube envelope.

Therefore, it is advantageous and desirable to provide an electron tube with a terminal end cap having means for permitting electrical connection of wires to the terminal pins of the tube and restricting the transmission of associated forces to the terminal pins.

SUMMARY OF THE INVENTION

Accordingly, this invention provides an electron tube including an evacuated envelope having an array of externally protruding terminal pins, and supporting a dielectric terminal cap. The cap comprises a cylindrical wall disposed to encircle at least one of the pins, and a transverse wall having disposed therein at least one pair of substantially perpendicular openings. A first wire attached directly to the encircled pin is routed through one of the openings in the transverse wall, and is attached directly to a second wire which is routed through the perpendicular opening therein. Thus, vibratory motion of the attached first and second wires is restricted by the limited lateral movement thereof permitted within the mutually perpendicular openings in the transverse wall. Also, a pulling force exerted on the second wire is expended by bringing the first wire laterally against the adjacent wall surface of its associated opening.

Moreover, one of the attached wires may be provided with an excess length, as in the form of a service loop, for example. Also, one of the attached wires may be provided with an axial movement restraining means, such as a washer fixedly attached to the wire and engaging a radial protruding portion of the transverse wall, for example. Thus, the effect of a pulling force on the second wire may be further expended in the excess material of the service loop or in the resistance of the axial movement restraining means. As a result, the terminal pin connected to the first wire is subjected to only minimal forces, which are insufficient to bend the pin or cause fracturing of the tube envelope.

A preferred embodiment of the invention comprises an electron tube of the cathode ray type, such as a display tube, for example, having an evacuated envelope provided with a neck end portion wherein an electron gun is axially disposed. Spaced electrodes of the gun are electrically connected to respective terminals which extend externally in an annular array from the neck end portion of the envelope. A dielectric terminal cap, which encloses the array, comprises a cylindrical wall encircling external portions of the terminal pins and supporting an end wall wherein respective pairs of axially extending and transversely extending bores are disposed. First wires attached directly to the respective terminal pins are routed through axially extending bores in the end wall, and are attached directly to respective second wires routed through transverse bores therein. Other wires may be attached directly to respective terminal pins and routed out of the terminal cap by way of an axially extending bore therein.

An alternative embodiment may include a dielectric terminal cap comprised of a cylindrical wall encircling the annular array of terminal pins and a transversely extending bridge wall which is disposed between chordal openings. The bridge wall has disposed therein respective pairs of transversely extending bores and longitudinally extending bores. First wires attached directly to the terminal pins are routed through one of the chordal openings and through one of the transversely extending bores for direct attachment to respective second wires routed through the longitudinally extending bores.

BRIEF DESCRIPTION OF THE DRAWINGS

For a better understanding of this invention, reference is made in the following detailed description to the drawings wherein.

DETAILED DESCRIPTION OF THE PREFERRED EMBODIMENTS

Figure 1:
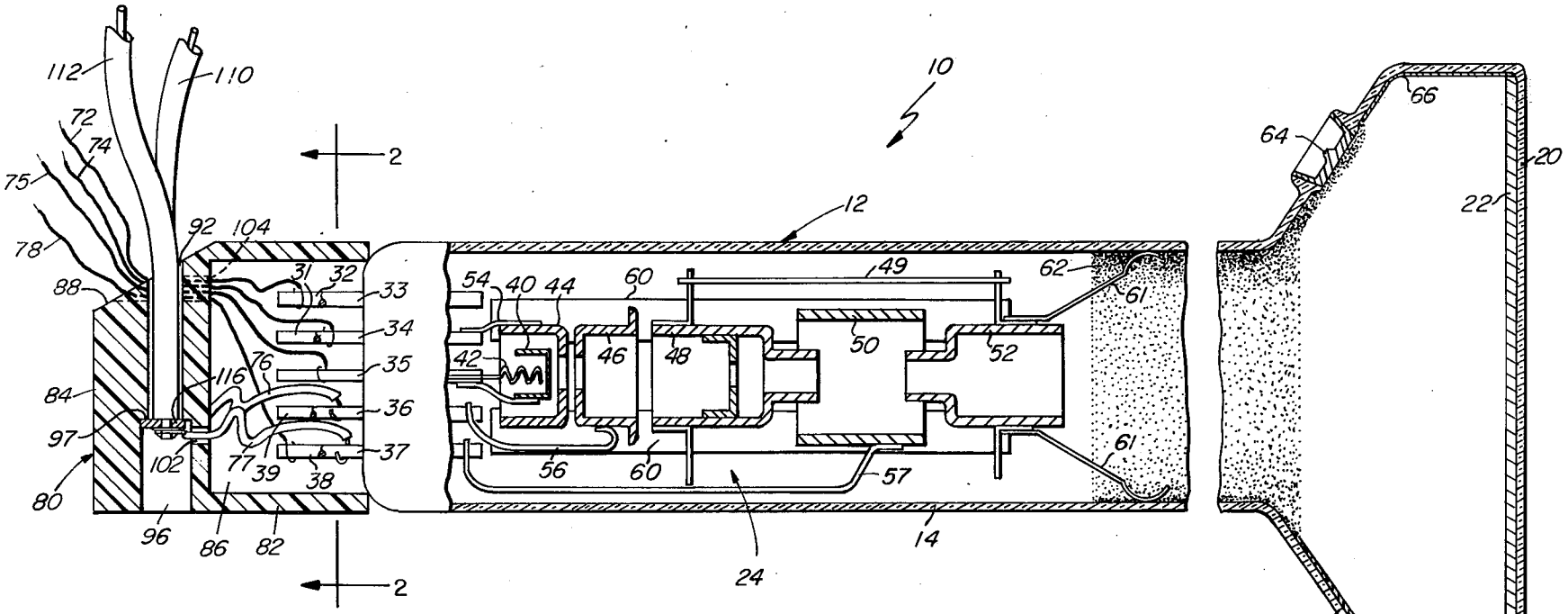
FIG. 1 is a longitudinal sectional view of an electron tube and terminal cap embodying the invention.

Referring to the drawings wherein like characters of reference designate like parts, there is shown in FIG. 1 an electron tube 10 of the cathode ray type, such as a display tube, for example, having an evacuated tubular envelope 12. Envelope 12 preferably is made of a dielectric vitreous material, such as glass, for example, and has a neck end portion 14 integrally joined by an outwardly flared, intermediate portion 16 to an opposed, larger diameter end portion 18. The end portion 18 terminates in a peripherally sealed end plate 20 having disposed adjacent its inner surface an imaging screen 22 comprised of a layer of suitable fluorescent material, such as zinc sulfide, for example. The screen 22 fluoresces locally when successive incremental areas thereof are scanned, in a well-known manner, by a high energy electron beam emanating from an electron gun 24 axially disposed in the neck portion 14 of envelope 12.

Figure 2:
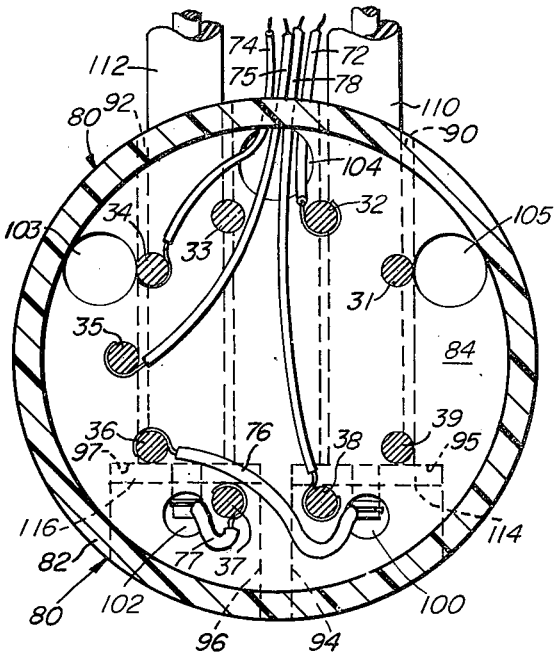
FIG. 2 is a cross-sectional view taken along the line 2—2 shown in FIG. 1 and looking in the direction of the arrows.

The neck end portion of envelope 12 terminates, as shown in FIG. 2, in an annular array of terminal pins, such as 31–39, for example, which extend axially and hermetically though the envelope 12 for connection to associated electrodes of the electron gun 24 within neck end portion 14. The electron gun 14 includes an indirectly heated cathode cup 40 having supported therein a filament 42, which are axially disposed adjacent the stem press 26 for emitting electrons in the direction of the larger diameter end portion 18 of envelope 12. Terminal end portions of the filament 42 are electrically connected to associated terminal pins 32 and 38, respectively; and the cathode cup 40 is electrically connected to a respective terminal pin, such as pin 35, for example.

Other axially spaced electrodes of electron gun 24 may include, in the order of axial distance from cathode 40, first and second beam forming grid cups, 44 and 46, respectively, a first electron accelerating grid cylinder 48, a beam focusing grid cylinder 50, and a second electron accelerating grid cylinder 52. The first and second grid cups 44 and 46 are inverted with respect to one another and have adjacent closed ends provided with respective central apertures which are aligned with the cathode cup 40. The first grid cup 44 may be electrically connected to terminal pins 31, 34, and 39 through respective welded conductive strips, such as conductive strip 54, for example, for the additional purpose of supporting the electron gun 24 within the neck end portion 14. The other axially spaced electrodes 46, 48, 50 and 52 respectively may be supported in coaxial alignment with the cathode 40 by wellknown means, such as annularly spaced dielectric posts 60 attached to the first grid cup 44, for example.

The second grid cup 46 is electrically connected through a welded conductive strip 54 to an associated terminal pin, such as 36, for example. The remaining electrodes 48, 50, and 52, respectively, constitute an Einzel lense wherein the first electron accelerating grid cylinder 48 is electrically connected, as by welded conductor 49, for example, to the second electron accelerating grid cylinder 52; and each has a reduced diameter end portion protruding insulatingly into respective adjacent ends of the interposed grid cylinder 50. The beam focusing grid cylinder 50 is electrically connected through a welded conductor 57 to an associated terminal pin, such as pin 37, for example. Projecting radially from the other end portion of electron accelerating cylinder 52 is a plurality of angularly spaced arms 60 which resiliently contact a coating 62 of conductive material, such as graphite, for example, deposited annularly on the surrounding wall of neck end portion 14. The coating 62 extends annularly onto the sloped inner wall surface of intermediate portion 16 and is electrically connected to a button-type terminal 64 extending hermetically through the wall of intermediate portion 16. The button-type terminal also is electrically connected to a coating 66 of conductive material, such as aluminum, for example, which extends annularly on the sloped wall of intermediate portion 16 and the inner cylindrical surface of larger diameter portion 18 to electrically connect to the imaging screen 22.

In operation, the button-type terminal 64 provides externally connecting electrical means for maintaining the imaging screen 22, the conductive coatings 66 and 62, respectively, and the electron accelerating grid cylinders 52 and 48, respectively, at a suitable electrical potential, such as ten to fifteen thousand volts, for example, with respect to the potential of cathode 40. The terminal pins 37 and 36 provide respective external connecting electrical means for maintaining the beam focusing grid cylinder 50 and the second beam forming grid cup 46 at suitable electrical potentials, such as 500 to 800 and 300 to 500 volts, respectively, for examples, with respect to the potential of cathode 40. Similarly, the terminal pins 31, 34, and 39 provide respective external connecting means for maintaining the first beam forming grid cup 44 at a suitable electrical potential, such as a negative 10 to 70 volts, for example, with respect to the potential of cathode 40. However, since the voltages applied to the terminal pins 37 and 36 are much higher than the voltages applied to the other terminal pins, the wires carrying the higher voltages may be required to have a correspondingly heavier insulation. Thus, when the wires are attached directly to the terminal pins to avoid open circuit rejections during shock and vibration testing, the heavier insulated wires may act as levers in bending the connected terminal pins and fracturing the surrounding vitreous material of envelope 12.

In order to avoid the undesirable effects of the heavy insulated wires, stripped end portions of smaller diameter, insulated wires 72, 74, 75, 76, 77, and 78, respectively, are attached as by soldering, for example, to external end portions of respective terminal pins 32, 34, 35, 36, 37, and 38. Fitted over the annular array of terminal pins 31–39 is a cup-shaped cap 80 made of dielectric material, such as fiberglass epoxy resin, for example. The cap 80 comprises a cylindrical wall 82 having one end closed by a transversely disposed end wall 84 to form an open-ended cavity 86 wherein the terminal pins 31–39 extend axially. An external surface area 88 of the end wall 84 may be sloped to provide means for routing wires protruding therefrom in a desired direction.

Extending from the sloped surface 88 and transversely through the end wall 84 are respective bores 90 and 92 which communicate with inner ends of aligned counterbores 94 and 96, respectively, having larger diameters. Consequently, the inner ends of counterbores 94 and 96 are defined by respective annular shoulders 95 and 97 which encircle the communicating openings of the smaller diameter bores 90 and 92, respectively. Disposed in the cylindrical wall surfaces of counterbores 90 and 92 are openings of respective axially extending bores 100 and 102 which communicate with the cavity 86. Thus, the axially extending bores 100 and 102 are substantially perpendicular to the transversely extending bores 90 and 92, respectively. Also, communicating with the cavity 86 is a plurality of bores, such as 103, 104, and 105, respectively, which extend entirely through the end wall 84 and have respective openings disposed in the sloped surface area 88 thereof.

Figure 3:
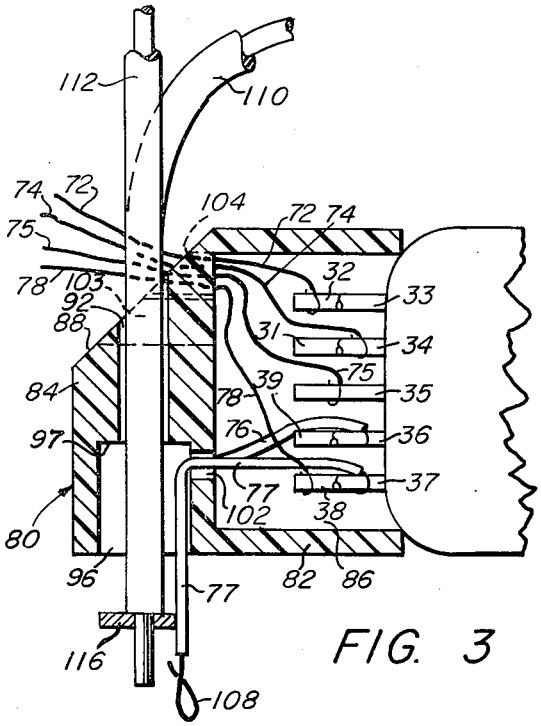
FIG. 3 is a fragmentary longitudinal sectional view showing one processing step for assembling the invention.

As shown in FIG. 3, the wires 72, 74, 75, and 78 may be routed through one of the bores 103-105 extending axially through the end wall 84, whereas the wires 76 and 77 are routed through axially extending bores 100 and 102, respectively. Consequently, the wires 100 and 102 are drawn through the openings of counterbores 90 and 92, respectively, in the cylindrical surface of end wall 84 while the respective wires 72, 74, 75, and 78 are drawn through the bore 104 to bring the open end of cap 80 into butting engagement with the envelope 12. The end portions of the wires 76 and 77 protruding from the counterbores 94 and 96, respectively, are stripped and formed into respective loops 106 and 108. Heavy insulated wires 110 and 112, respectively, are routed through respective transversely extending bores 90 and 92 and the aligned counterbores 94 and 96, respectively. The protruding end portions of heavy insulated wires 110 and 112, respectively, are stripped and passed through central apertures of respective washers 114 and 116. The washers 114 and 116 are fixedly attached as by soldering, for example, to the stripped end portions of heavy insulated wires 110 and 112, respectively, which are then drawn back into the respective counterbores 94 and 96 until the attached washers 114 and 116 seat against the annular shoulders 95 and 97, respectively.

Figure 4:
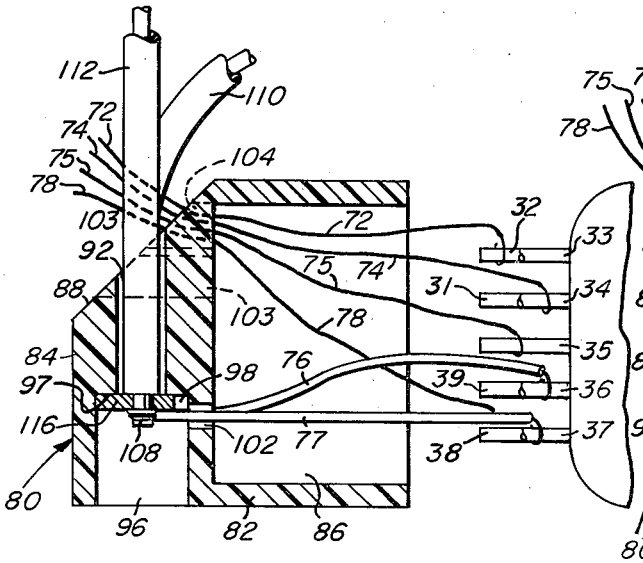
FIG. 4 is a fragmentary longitudinal sectional view showing a second processing step for assembling the invention.

As shown in FIG. 4, the end cap 80 may be pulled axially away from butting engagement with the envelope 12 to draw the wires 76 and 77 back through the respective counterbores 90 and 92, and the communicating axially extending bores 100 and 102, respectively. The loops 106 and 108 formed in the free end portions of small diameter wires 76 and 77, respectively, are fitted over the stripped end portions of the heavy insulated wires 110 and 112, respectively, and attached thereto, as by soldering, for example. Any stripped end portion of the heavy insulated wires 110 and 112 protruding beyond the cylindrical surface of end wall 84 then may be trimmed off, by any convenient means, such that the remaining end portions are completely disposed within the counterbores 94 and 96, respectively. Alternatively, the respective loops 106 and 108 formed in the stripped end portions of small diameter insulated wires 76 and 77 may be fitted over the stripped end portions of heavy insulated wires 110 and 112, respectively, and fixedly attached thereto, while the stripped end portions are protruding from the respectively counter bores 94 and 96. However, when feeding the small diameter, insulated wires 76 and 77 back through the axially extending bores 100 and 102, respectively, it is preferable that the wires 76 nd 77 have maximum freedom of movement.

Figure 5:
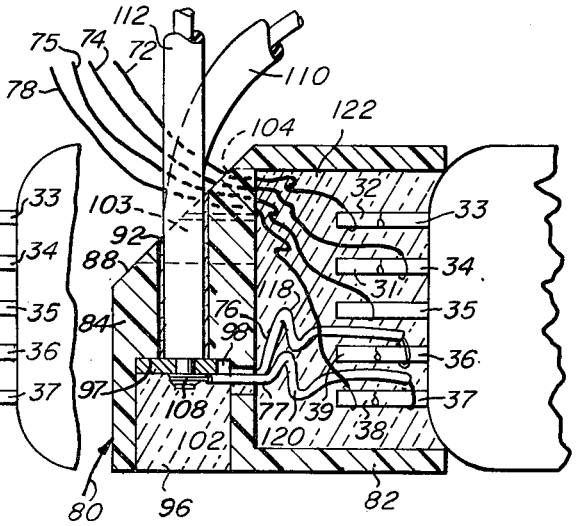
FIG. 5 is a fragmentary longitudinal sectional view showing a third processing step for assembling the invention.

As shown in FIG. 5, the neck portion 14 of tube 10 then may be urged back into engagement with the open end of cap 80, thus causing the excess length of small diameter wires 76 and 78 within cavity 86 to form respective service loops 118 and 120. Similarly, excess lengths of small diameter wires 72, 74, 75, and 78 may be provided within cavity 86 for forming therein respective service loops. Alternatively, the excess lengths of small diameter wires 72, 74, 75, and 78 may be withdrawn through the axially extending bore 104 when the neck portion 14 of tube 10 is urged into engagement with the open end of cap 84. When the open end of cap 84 is again abutting envelope 12, it may be affixed thereto by any convenient temporary means, such as a suitable tape, for example. Subsequently, a dielectric potting adhesive compound 122, such as silicone rubber, for example, may be mixed with a suitable catalyst and injected, as by means of a suitable syringe, for example, into one of the axially extending bores, such as 103 or 105, for example. The potting compound 122, when cured, fixedly attaches the cap 80 to the envelope 12; and the temporary means, such as a tape, for example, used to secure the cap to the envelope may be removed. Preferably, the potting compound 122 fills the cavity 86, the axially extending bores 100-105, and the counterbores 94 and 96, respectively. Thus, the small diameter wires 72, 74, 75, 76, 77, and 78 are further insulated from one another within cavity 86 by the interposed dielectric material of the potting compound 122.

Accordingly, a pulling force exerted on the heavy insulated wires 110 and 112 is resisted by the respectively attached washers 114 and 116 bearing against the adjacent annular shoulders 95 and 97, respectively. Furthermore, axial movement of the heavy insulated wires 110 and 112 is restricted by the limited lateral movement of the respectively attached wires 76 and 77 within the perpendicularly disposed bores 100 and 102, respectively. Similarly, axial movement of the small diameter wires 76 and 77 is restricted by the limited lateral movement of the respectively attached wires 110 and 112 within the perpendicularly disposed bores 90 and 92, respectively. Also, the limited lateral movement of heavy insulated wires 110 and 112 within the transverse bores 90 and 92 may cause a correspondingly limited axial movement of the attached end portions of respective small diameter wires 76 and 77 which is taken up in the service loops 118 and 120, respectively. Thus, axial and lateral vibratory movement of the heavy insulated wires 110 and 112 has minimal effect on the electrically connected terminal pins 36 and 37, respectively.

Figure 6:
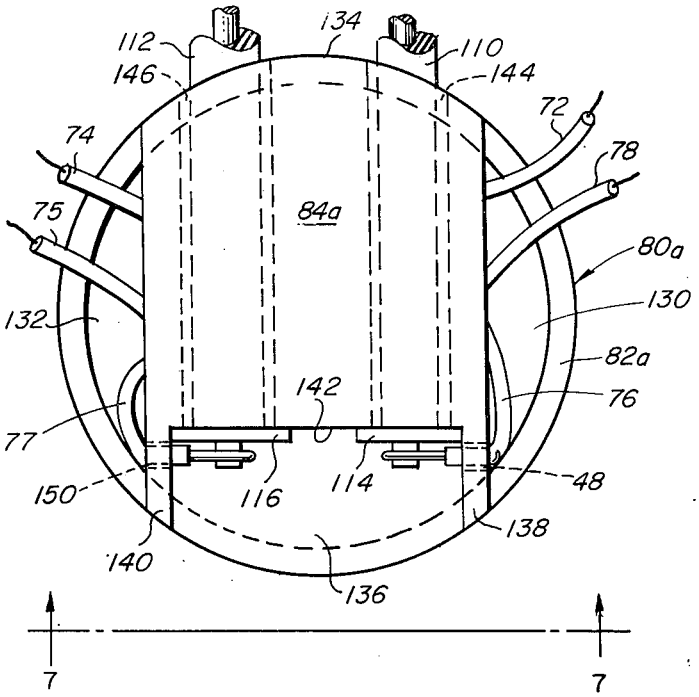
FIG. 6 is an end view of an alternative embodiment of the invention.
Figure 7:
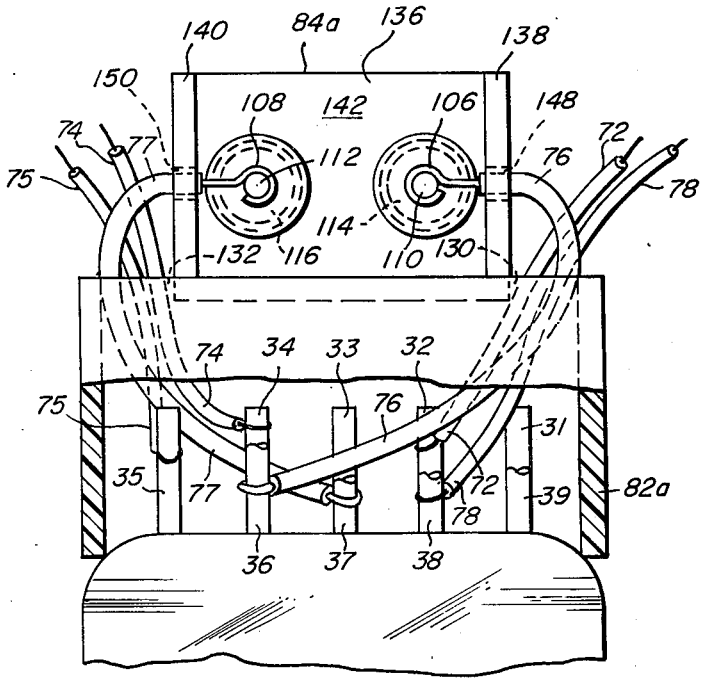
FIG. 7 is a fragmentary elevational view, partly in section, taken along the line 7—7 shown in FIG. 6 and looking in the direction of the arrows.

As shown in FIGS. 6 and 7, an alternative embodiment may include the tube 10, as described, with a terminal end cap **80*a* fitted over the annular array of terminal pins 31–39 extending from neck end portion 14 of envelope 12. The cap 80*a* comprises a cylindrical wall 82*a* having one end supporting a transversely disposed bridge-type wall 84*a* which has a width less than the inner diameter of cylindrical wall 82*a*. Accordingly, disposed between opposing sides of the end wall 84*a* and the cylindrical wall 82*a* are respective chordal openings 130 and 132 through which the small diameter wires 72, 74, 75, 76, 77, and 78 may extend from attached terminal pins 32, 34, 35, 36, 37, and 38, respectively. Also, a potting compound 122*a* may be injected through one or both of the chordal openings 130 and 132, respectively, to fill the cap 80*a* and fixedly secure it to the envelope 12 of tube 10**.

The bridge-type end wall **80*a* may have a cylindrical end surface 134 conforming to the cylindrical exterior surface of wall 82*a* and an opposing end portion provided with a stepped recess 136. The recess 136 is defined by opposing side walls 138 and 140, respectively, and substantially perpendicular rear wall surface 142. Extending longitudinally through the wall 82*a*, and thus transversely with respect to the cap 80***a*, are laterally spaced bores 114 and 146, respectively, each of which has an opening in the cylindrical end surface 134 of wall 84*a* and an opposing opening in the rear wall surface 142 of recess 136. Extending transversely through the side walls 138 and 140 of recess 136 and substantially perpendicular to the bores 144 and 146 are bores 148 and 150, respectively. The heavy insulated wires 110 and 112 are routed through respective transverse bores 144 and 146 to protrude into the recess 136. Also, the small diameter, insulated wires 76 and 77 are routed through respective bores 148 and 150 in side walls 138 and 140, respectively, to protrude into the recess 136.

In a manner previously described, the heavy insulated wires 110 and 112 have respective protruding end portions in recess 136 stripped and have attached thereto axial movement restraining means, such as washers 114 and 116, respectively. Subsequently, the heavy insulated wires 110 and 112 are pulled back through respective bores 144 and 146 until the washers 114 and 116, respectively, seat against the rear wall surface 134 of recess 136. Also, as previously described, the smaller diameter, insulated wires 76 and 77 have respective protruding end portions in recess 136 stripped and formed into respective loops 106 and 104, which are fitted over the stripped end portions of heavy insulated wires 110 and 112, respectively. The loops 106 and 108 of smaller diameter wires 76 and 77, respectively, then are fixedly attached to the stripped end portions of the heavy insulated wires 110 and 112, respectively, by any suitable means, such as soldering, for example. The smaller diameter 76 and 77 may be provided with respective excess lengths for forming therein respective service loops 118 and 120, respectively, before the potting compound 122*a* is injected into the cap 80*a*. Preferably, the recess 136 also is filled with the potting compound 112*a* until flush with the exterior surfaces of end wall 84*a*.

Thus, the heavy insulated wires 110 and 112 are provided with respective axial movement restraining means for esisting pulling forces exerted on the wires. Also, the heavy insulated wires and the attached small diameter wires are routed through mutually perpendicular bores which limit axial and lateral movements of the attached wires. Furtermore, the small diameter wires 76 and 77 may be provided with respective service loops 118 and 120 to compensate for lateral movement of the heavy insulated wires 110 and 112, respectively, causing axial movement of the attached end portions of the smaller diameter wires. Accordingly, axial and lateral vibratory movements of the heavy insulated wires 110 and 112 have minimal effect on the electrically connected terminal pins 36 and 37, respectively.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described is to be interpreted as illustrative rather than in a limiting sense.

What is claimed is:

1. The combination comprising:

an electron tube including an evacuated envelope, and at least one terminal pin extending externally of the envelope;

a dielectric cap including a cylindrical wall encircling the pin and a transversely disposed wall having therein at least one pair of substantially mutually perpendicular openings;

a first wire attached directly to the terminal pin and extending through one of the openings in the transversely disposed wall; and a second wire attached to the first wire and extending through the other opening in the transversely disposed wall.

2. The combination as set forth in claim 1 wherein the cap is cup-shaped and the transversely disposed wall extends entirely across one end of the cylindrical wall to form an open-ended cavity wherein the terminal pin is axially disposed.

3. The combination as set forth in claim 2 wherein one of the openings is disposed axially of the cap and the other opening is disposed transversely thereto.

4. The combination as set forth in claim 3 wherein the openings comprise respective bores disposed in communication with one another.

5. The combination as set forth in claim 1 wherein the transversely disposed wall extends only partly across one end of the cylindrical wall.

6. The combination as set forth in claim 4 wherein both of the substantially perpendicular openings extend transversely of the cap.

7. The combination as set forth in claim 6 wherein the cap includes a recess disposed in communication with the openings.

8. The combination as set forth in claim 1 including movement restraining means affixed to at least one of the wires for restricting axial movement thereof relative to the other wire.

9. The combination as set forth in claim 1 including service loop means disposed in at least one of the wires for minimizing axial transmission of movement from one end of the wire to the other end thereof.

10. The combination as set forth in claim 1 including at least one additional opening in the transversely disposed wall extending entirely therethrough and axially of the cap.

* * * * *